US008223019B2

(12) United States Patent
August et al.

(10) Patent No.: US 8,223,019 B2
(45) **Date of Patent: *Jul. 17, 2012**

(54) FIREARM MAINTENANCE

(75) Inventors: M. Jason August, Toronto (CA); John K. Stevens, Stratham, NH (US); Paul Waterhouse, Selkirk (CA)

(73) Assignee: Visible Assets, Inc., Mississauga, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/510,000

(22) Filed: Jul. 27, 2009

(65) Prior Publication Data

US 2011/0067282 A1 Mar. 24, 2011

Related U.S. Application Data

(63) Continuation-in-part of application No. 12/108,877, filed on Apr. 24, 2008.

(60) Provisional application No. 61/084,165, filed on Jul. 28, 2008.

(51) Int. Cl.
*G08B 13/14* (2006.01)

(52) U.S. Cl. ..... 340/572.1; 340/572.7

(58) Field of Classification Search ..... None
See application file for complete search history.

(56) References Cited

U.S. PATENT DOCUMENTS

| | | | | |
|---|---|---|---|---|
| 7,049,963 | B2 * | 5/2006 | Waterhouse et al. | 340/572.1 |
| 2004/0257231 | A1 * | 12/2004 | Grunes et al. | 340/572.1 |
| 2005/0093702 | A1 * | 5/2005 | Twitchell, Jr. | 340/572.8 |
| 2007/0035383 | A1 * | 2/2007 | Roemerman et al. | 340/10.1 |
| 2007/0063895 | A1 * | 3/2007 | August et al. | 342/359 |
| 2008/0074262 | A1 * | 3/2008 | Paulkovich | 340/572.1 |
| 2008/0191847 | A1 * | 8/2008 | August et al. | 340/10.42 |
| 2009/0212117 | A1 * | 8/2009 | August et al. | 235/492 |
| 2009/0219156 | A1 * | 9/2009 | August et al. | 340/572.1 |
| 2010/0031552 | A1 * | 2/2010 | Houde-Walter | 42/72 |
| 2010/0251586 | A1 * | 10/2010 | Packer et al. | 42/1.01 |

* cited by examiner

*Primary Examiner* — Julie Lieu
(74) *Attorney, Agent, or Firm* — Larson & Anderson, LLC

(57) ABSTRACT

A method for identifying, tracking, and monitoring a firearm includes steps of: attaching a low frequency radio tag to the firearm; storing, in the data storage device of the radio tag, identification data relating to the firearm; and reading the identification data from the transceiver by interrogating the radio tag. The radio tag includes a shot sensor, a shot count register for tracking the number of shots fired and cadence registers for tracking the intervals between shots.

19 Claims, 6 Drawing Sheets

A RuBee radio tag embedded in handle. Tag may be read via a portal in a room equipped with loop antenna or on a smart shelf. Tag life five years to fifteen years. Tag portal range 15-20 feet, tag , open room range 50' x 50'

A RuBee radio tag embedded in handle. Tag may be read via a portal in a room equipped with loop antenna or on a smart shelf. Tag life five years to fifteen years. Tag portal range 15-20 feet, tag, open room range 50' x 50'

| Memory location | Name | Value |
|---|---|---|
| 0 | total shots fired | 5000 |
| 1 | 750-900 rounds/min | 4000 |
| 2 | 500-750 | 0 |
| 3 | 250-500 | 0 |
| 4 | 100-250 | 0 |
| 5 | 60-100 | 0 |
| 6 | 30-60 | 0 |
| 7 | 10-30 | 1000 |
| 8 | Cool time 0-60 | 0 |
| 9 | cool time 61-300 sec | 0 |
| 10 | cool time 301—600 sec | 0 |
| 11 | cool time over 600 sec | 400 |
| 12 | firearm type | SCAR-H |
| 13 | barrel length | short |
| 14 | ammunition type | 7.62 hot |

Fig. 3

Tag May Contain Use and Performance Data via onboard sensors. Data maybe read and entered via Handheld.

Number of Shots — 2045
Last Shot Date — 04/01/07
Number Last Shot — 45
Max Temperature — 32C
Last Maintenance — 04/02/07

| Firearm Maintenance Report | | | | | |
|---|---|---|---|---|---|
| Firearm ID | GroupID | LastMaint | Shot Count | MKSC | Status |
| 012045 | LVPD | 20080516 | 230 | 212 | Operable |
| 013056 | LVPD | 20080520 | 5 | 5 | Operable |
| 020788 | LVPD | 20080516 | 307 | 307 | Needs Maint. |
| 021005 | LVPD | 20080516 | 105 | 104 | Operable |
| 021107 | LVPD | 20080516 | 206 | 200 | Operable |

Fig. 5

FIREARM MAINTENANCE

CROSS-REFERENCE TO RELATED APPLICATIONS

This application is a non-provisional of and claims priority from, U.S. Patent Application Ser. No. 61/084,165, filed on Jul. 28, 2008, which is a continuation-in-part of, and claims priority from, commonly-owned, co-pending U.S. patent application Ser. No. 12/108,877, "Firearm Visibility Network," filed on Apr. 24, 2008, which application is incorporated by reference as if fully set forth herein.

STATEMENT REGARDING FEDERALLY SPONSORED-RESEARCH OR DEVELOPMENT

None.

INCORPORATION BY REFERENCE OF MATERIAL SUBMITTED ON A COMPACT DISC

None.

TRADEMARKS

RuBee® is a registered trademark of Visible Assets, Inc. of the United States. Other names used herein may be registered trademarks, trademarks or product names of Visible Assets, Inc. or other companies.

FIELD OF THE INVENTION

The invention disclosed broadly relates to the field of firearms and more specifically to monitoring the maintenance for a firearm.

BACKGROUND OF THE INVENTION

When firearms are shot the barrel and its other parts experience various degrees of wear and tear. In the case of semi-automatic or automatic firearms (such as the SigSauer 556 or Colt M41A automatic rifles), each firing cycle results in the expansion of the chamber by the hot corrosive gases, the acceleration of the bullet down the barrel, and an ejection of the spent case and re-loading of a new cartridge for the next firing cycle. This cycle may be repeated in different rates such as single shots, burst fire (e.g. 3 shots in rapid succession) and full automatic fire. All of the weapons parts wear, including those in the gun's action and barrel such as the hammer, firing pin, and the bolt, as well as the chamber, gas ports/vents, barrel, and the various springs, screws, and washers in a gun that control the magazine, control recoil, control gases, and control movement of bullets into the chamber.

The parts become progressively worn until they are no longer serviceable and must be repaired or replaced. In many cases the wear status of these parts and overall usefulness (accuracy) and safety of the firearm is directly proportional to the number of shots that have been fired. Therefore, routine maintenance on a firearm is critical, especially for professionals who depend on the accuracy and reliability of the weapon, such as those in the military and law enforcement disciplines. Unfortunately, the need for routine maintenance is typically calculated by the shooter's memory of the type (rapid fire versus single shot), firing cadence and the total number of shots fired since the prior maintenance.

This is not accurate because humans can fail to remember the exact total number of shots fired or the proportion of those shots fired at a specific rate of fire (also known as cadence), especially in war or other hostile situations. For example, a manufacture may recommend that routine maintenance be performed (for example, changing the springs) after 3,000 rounds. Or, after 10,000 rounds the barrel should be replaced, and so on. In many other weapons the wear and tear may be accelerated depending upon how close the rounds were fired together. This is especially true in automatic and semi-automatic weapons that can fire up to 13-15 rounds per second. At this rate the heat generated from bullets can have a harmful affect on the barrel and other moving parts, especially if it is a sustained action. For example, if a specific firearm (automatic or semi-automatic type) has a total of 3,000 rounds fired over its lifetime, the rate of fire for these past firings has a profound effect on the maintenance required by the firearm. For a specific type and model of firearm, a firing rate of one shot per second for 3,000 rounds may be acceptable for maximum barrel life, bolt life, spring life and overall maximum lifespan of the weapon. However, if the same 3,000 rounds are shot at much higher rates of fire such as ten rounds per second, the accelerated wear may make the weapon inaccurate, or unusable and unsafe.

For more background on the effect of shot cadence and accuracy, reliability, and safety for military firearms, refer to the public document "SOPMOD Program Overview" published by the NSWC of the US Navy on April, 2006.

Therefore a system that monitors shots and shot timing is necessary for these weapons.

SUMMARY OF THE INVENTION

Briefly, according to an embodiment of the present invention, a method for identifying, tracking, and monitoring a firearm includes steps of: attaching a low frequency radio tag to the firearm; storing, in the data storage device of the radio tag, identification data relating to the firearm and data related to the shot count; reading the identification data from the transceiver by interrogating the radio tag; and transmitting the identification data and shot count data. The radio tag includes a shot sensor, a shot count register for tracking the number of shots fired and cadence registers for tracking the intervals between shots.

BRIEF DESCRIPTION OF THE DRAWINGS

To describe the foregoing and other exemplary purposes, aspects, and advantages, we use the following detailed description of an exemplary embodiment of the invention with reference to the drawings, in which:

FIG. 3 shows possible memory allocations for the mean kinetic shot data, according to an embodiment of the present invention;

FIG. 5 shows a screenshot showing a possible web interface according to an embodiment of the present invention.

Figure 1:
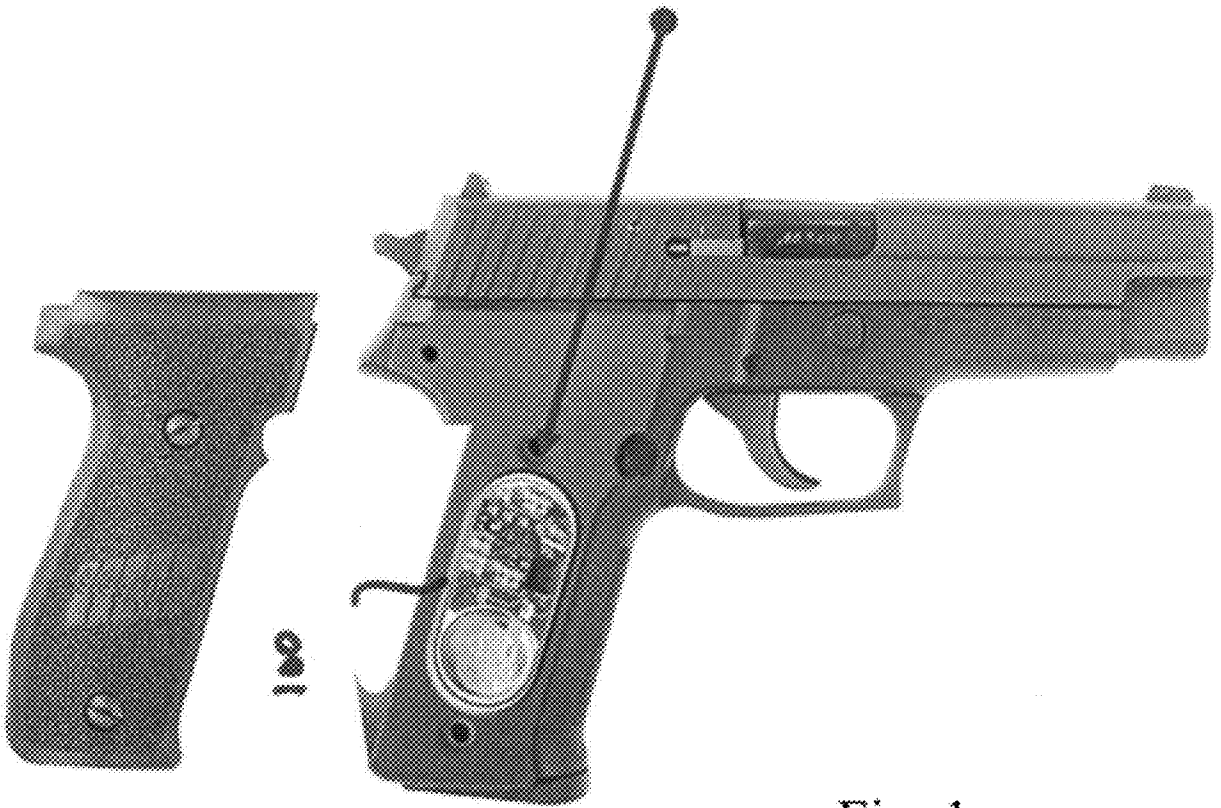
FIG. 1 is an illustration of an exemplary firearm with an affixed tag, according to an embodiment of the present invention.

While the invention as claimed can be modified into alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the scope of the present invention.

DETAILED DESCRIPTION

We describe a mean kinetic shot (MKC) system and method for providing automatic shot counting and maintenance management of firearms within a network. The MKC system uses the RuBee® radio tag as described in co-pending application Ser. No. 12/108,877. The net effect is that the MKC empirically reflects the actual wear and tear on the weapon based not simply on number of shots, but how fast those shots were fired.

According to the present invention, a method and apparatus stores shot data to create a simplified way to monitor and gauge the overall effect of firing rate fluctuation or variation on the lifespan of a firearm. The method further provides an indicator of the safety and/or accuracy of a specific firearm as a single calculated value. This value, called a Mean Kinetic Shot Count or MKSC, is a weighted average of fired shots.

The key feature of this invention is the RuBee® active tag system. RuBee® is a radio tag technology designed to provide full asset visibility and identification in harsh environments. The tags use the standard, IEEE P1902.1, "RuBee Standard for Long Wavelength Network Protocol," which allows for networks encompassing thousands of radio tags operating below 450 KHz. RuBee® networks provide for real-time tracking under harsh environments, e.g., near metal and water and in the presence of electromagnetic noise. The tags are also programmable.

Background on RuBee® Radio Tags.

Radio tags communicate via magnetic (inductive communication) or electric radio communication to a base station or reader, or to another radio tag. A RuBee® radio tag works through water and other bodily fluids, and near steel, with an eight to fifteen foot range, a five to ten-year battery life, and three million reads/writes. It can operate at 132 KHz and is a full on-demand peer-to-peer, radiating transceiver.

RuBee® is a bidirectional, on-demand, peer-to-peer transceiver protocol operating at wavelengths below 450 KHz (low frequency). A transceiver is a radiating radio tag that actively receives digital data and actively transmits data by providing power to an antenna. A transceiver may be active or passive. The RuBee® standard is documented in the IEEE Standards body as IEEE P1902.1.

Low frequency (LF), active radiating transceiver tags are especially useful for visibility and for tracking both inanimate and animate objects with large area loop antennas over other more expensive active radiating transponder high frequency (HF)/ultra high frequency (UHF) tags. These LF tags function well in harsh environments, near water and steel, and may have full two-way digital communications protocol, digital static memory and optional processing ability, sensors with memory, and ranges of up to 100 feet. The active radiating transceiver tags can be far less costly than other active transceiver tags (many under one dollar), and often less costly than passive back-scattered transponder RFID tags, especially those that require memory and make use of EEPROM. With an optional on-board crystal, these low frequency radiating transceiver tags also provide a high level of security by providing a date-time stamp, making full AES (Advanced Encryption Standard) encryption and one-time pad ciphers possible.

One of the advantages of the RuBee® tags is that they can transmit well through water and near steel. This is because RuBee® operates at a low frequency. Low frequency radio tags are immune to nulls often found near steel and liquids, as in high frequency and ultra high-frequency tags. This makes them ideally suited for use with firearms made of steel. Fluids have also posed significant problems for current tags. The RuBee® tag works well through water. In fact, tests have shown that the RuBee® tags work well even when fully submerged in water. This is not true for any frequency above 1 MHz. Radio signals in the 13.56 MHz range have losses of over 50% in signal strength as a result of water, and anything over 30 MHz have losses of 99%.

Another advantage is that RuBee® tags can be networked. One tag is operable to send and receive radio signals from another tag within the network or to a reader. The reader itself is operable to receive signals from all of the tags within the network. These networks operate at long-wavelengths and accommodate low-cost radio tags at ranges to 100 feet. The standard, IEEE P1902.1, "RuBee Standard for Long Wavelength Network Protocol," will allow for networks encompassing thousands of radio tags operating below 450 KHz.

The inductive mode of the RuBee® tag uses low frequencies, 3-30 kHz VLF or the Myriametric frequency range, 30-300 kHz LF in the Kilometric range, with some in the 300-3000 kHz MF or Hectometric range (usually under 450 kHz). Since the wavelength is so long at these low frequencies, over 99% of the radiated energy is magnetic, as opposed to a radiated electric field. Because most of the energy is magnetic, antennas are significantly (10 to 1000 times) smaller than ¼ wavelength or 1/10 wavelength, which would be required to efficiently radiate an electrical field. This is the preferred mode.

As opposed to the inductive mode radiation above, the electromagnetic mode uses frequencies above 3000 kHz in the Hectometric range, typically 8-900 MHz, where the majority of the radiated energy generated or detected may come from the electric field, and a ¼ or 1/10 wavelength antenna or design is often possible and utilized. The majority of radiated and detected energy is an electric field.

RuBee® tags are also programmable, unlike RFID tags. The RuBee® tags may be programmed with additional data and processing capabilities to allow them to respond to sensor-detected events and to other tags within a network.

Additionally, RuBee® tags can be coupled with sensors so that activity parameters, such as shots fired can be accurately determined. RuBee® tags and base stations produce only microwatts of radio energy and it is this low output that makes them ideal for hospital and operating room (OR) applications. These signals are of such low frequency that there is no biological interaction. Labeled as a non-significant risk, RuBee® tags have no effect on cardiac pacemakers and automated external defibrillators (AEDs). RuBee® has a field strength that is even lower than that of airport metal detectors and antitheft detectors in retail stores.

Radio tags communicate via magnetic (inductive communication) or electric radio communication to a base station or reader, or to another radio tag. A RuBee® radio tag works through water and other bodily fluids, and near steel, with an eight to fifteen foot range, a five to ten-year battery life, and three million reads/writes. It operates at 132 kHz and is a full on-demand peer-to-peer, radiating transceiver.

RuBee® is a bidirectional, on-demand, peer-to-peer transceiver protocol operating at wavelengths below 450 kHz (low frequency). A transceiver is a radiating radio tag that actively receives digital data and actively transmits data by providing power to an antenna.

Low frequency (LF), active radiating transceiver tags are especially useful for visibility and for tracking both inanimate and animate objects with large area loop antennas over other more expensive active radiating transponder high frequency (HF)/ultra high frequency (UHF) tags. These LF tags function well in harsh environments, near water and steel, and may have full two-way digital communications protocol, digital static memory and optional processing ability, sensors with memory, and ranges of up to 100 feet. The active radiating transceiver tags can be far less costly than other active transceiver tags (many under one US dollar), and often less costly than passive back-scattered transponder RFID tags, especially those that require memory and make use of an EEPROM.

With an optional on-board crystal, these low frequency radiating transceiver tags also provide a high level of security by providing a date-time stamp, and make it possible to associate elapsed time with shots fired in order to record the shot cadence.

Firearm Embodiment.

Referring now in specific detail to the drawings and particularly FIG. 1, there is shown an exemplary firearm 100 with a RuBee® radio tag 102 embedded in the handle of the firearm 100. It is important to note that the firearm 100 shown here, a handgun, is shown for illustrative purposes only. Any firearm, whether a handgun, rifle, machine gun, or other firing weapon, can be advantageously used with the RuBee® tag 102 according to the present invention. As shown in FIG. 1, the radio tag 102 is small enough to easily fit into a hollow formed into the grip of the handgun 100. The firearm 100 shown in this example is a SIG SAUER® handgun, but the invention as discussed is not limited to handguns. The radio tag 102 could be advantageously used with any type of firearm or indeed most types of weaponry (swords, knives, and so forth) and some ammunition.

The grip is the preferred location for the tag 102, but not necessarily the only location that the RuBee tag 102 can be used. The tag 102 may be affixed to the outside of the firearm 100, although this is not the preferred arrangement. The radio tag 102 as shown in this example is preferably placed in the handgun grip, but it could be placed in another part of the firearm 100 if a different firearm form factor is used. The placement of the radio tag 102 depends on the form factor of the weapon and the size of the weapon. The tag 102 in this example is embedded into a cavity of the inside of the grip. Embedding the tag 102 in this manner is the preferred embodiment. Alternatively, the tag 102 may be affixed to the firearm 100 by attaching it to the outside surface of the weapon, but this is not recommended. The tag 100 may be constructed with a waterproof housing made to sustain wear and tear, yet remain lightweight.

The tag 102 is able to detect shots fired through a sensor using known detection technology, such as that used in piezoelectric sensors and inertial sensors. The sensor technology is analogous to that used with the currently popular Nintendo® Wii™ game console. Because the sensor can be very small, it is ideal for use with handguns and can easily fit within the handle of a handgun. One sensor is able to detect each shot that is fired through the chamber of the firearm, thus providing the ability to count the shots. By incorporating a timing device into the tag, such as a crystal, the cadence of the shots can be tracked as well.

For example, if a tag 102 associated with a specific firearm 100 has detected a total of 5,000 rounds fired, with 4,000 of those rounds fired in full automatic mode (e.g. 950 round/min for an M4A1 carbine in full-auto mode), and 1,000 rounds fired as single semi-automatically fired rounds with a rate less than 30 rounds/min, then a weighted average of the two values is useful in determining the effect of the shots fired on the weapon.

In another embodiment of the present invention, the MKSC provides a more meaningful measurement when it provides greater weight to additional factors. For example, more weight may be given to full-automatic firing rates versus slower firing rates. In one example, a firing rate will be assigned a progressively decreased weighting from a fire rate of 750-950 rounds/min, 500-750 rounds/min, 250-500 rounds/min, 100-250 rounds/min, to single shots at 60 rounds/min. The weights can be pre-loaded into the tag 102. Preferably, the weights are loaded into separate registers, with one fire rate associated with each register. Then, the number of shots fired at each firing rate are loaded into (added into) the appropriate register. This makes the calculation of a weighted average a simple matter of multiplying the count in each register by its associated weight value, then adding the products.

To further increase the meaningfulness of the MKSC, the weighting can be modified according to the specific weapon used (e.g. SigSauer 556, FN SCAR-H (7.62 mm) or FN SCAR-L (5.56 mm) or the Colt M4A1) and also other factors, such as ammunition type (size, power), barrel length, or if there is a specific rest or cooling period between rounds being fired at a specific rate (e.g. 0-60 seconds, 61-300 seconds, 301-600 seconds, over 600 seconds) and so forth.

For example, assume we are to provide a MKSC for a firearm with a total shot count of 5,000 rounds. Of those 5,000 rounds, 4,000 rounds are fired at 750-900 rounds/min. However, this weapon could have been fired as a combination of 400 ten shot full-auto groups each with a large cool down period of over 10 minutes (600 seconds) between each 10 shots. Alternatively, the rounds may have been fired with 10 seconds cool down between each 10 round full-auto burst. These scenarios can affect the cumulative stress on the weapon and therefore its overall lifespan, reliability, accuracy, and safety.

In order to apply a meaningful weighting, a preferred embodiment of the present invention uses a statistical database of firearm performance parameters correlated against the recorded shot cadences and the other stored values in the shot counting tag disclosed in the present invention.

Figure 2:
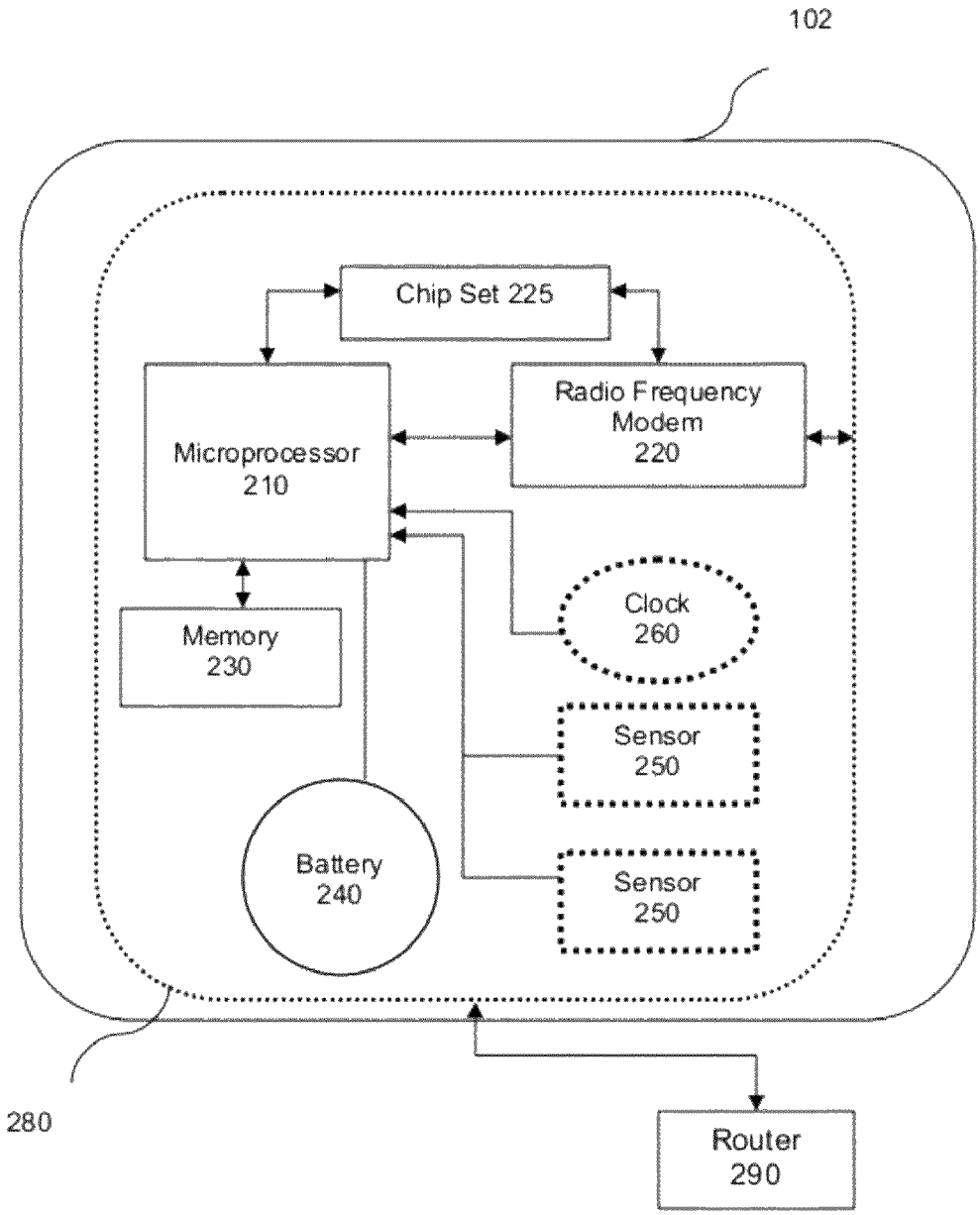
FIG. 2 is a simplified illustration of the tag of FIG. 1, according to an embodiment of the present invention.

Referring to FIG. 2 there is shown a simplified diagram showing the functional components of the RuBee tag 102 providing a MKSC, according to an embodiment of the present invention. The basic components of the tag 102, are: a modem 220, a chipset 225, an antenna 280, a power source 240, a microprocessor 210, and memory 230, and has a clock 269 (for example an accurate crystal oscillator) that provides accurate timing of shot rates.

The antenna 280 shown in FIG. 2 is an omni-directional small loop antenna with a range of approximately eight to fifteen feet. It is preferably a thin wire wrapped many times around the inside edge of the tag housing. A reader or monitor may be placed anywhere within that range in order to read signals transmitted from the tag 102 or the tag's sensor(s) 250.

The energy source shown in this example is a battery 240, preferably a lithium (Li) CR2525 battery approximately the size of an American quarter-dollar with a five to fifteen year life and up to three million read/writes. Note that only one example of an energy source is shown. The tag 102 is not limited to a particular source of energy, the only requirement is that the energy source is small in size, lightweight, and operable for powering the electrical components.

The tag 102 also includes a memory 230 and a four bit microprocessor 210, using durable, inexpensive 4 micron CMOS technology and requiring very low power. What has been shown and discussed so far is a basic embodiment of the tag 102. With the components as discussed, the tag 102 can perform the following functions: 1) the tag 102 can be configured to receive (via the modem 220) and store data about the firearm to which it is attached and/or the network to which it belongs (in the memory 230); 2) the tag 102 can emit signals which are picked up by a reader, the signals providing data about the firearm; 3) the tag 102 can store data in the form of an internet protocol address so that the tag's data can be read on the internet.

Note that the electrical components of the tag 102 are housed within the body of the tag 102 and are completely enclosed within the tag 102 when the device is sealed. This makes the tag 102 waterproof and tamperproof. All communications take place at very low frequencies (e.g. under 300 kHz). By using very low frequencies the range of the tag 102 is somewhat limited; however power consumption is also greatly reduced. Thus, the receiver of modem 220 may be on at all times and hundreds of thousands of communication transactions can take place, while maintaining a life of many years (up to 15 years) for battery 240.

Operatively connected to the modem 220 is a RuBee® chipset 225. The chipset 225 is configured to detect and read analog voltages. The chipset 225 is operatively connected to the modem 220 and the microprocessor 210.

The tag's memory 230 records the shots fired as detected by the sensor 250 in accordance with their firing cadence or rate or other factors (e.g. rest or cool down interval). Each shot that is fired can be counted and then recorded to a specific memory "bin" or register which identifies how fast the shot was fired.

As shown in FIG. 3, a register is created in a processor of the chip that stores the total number of shots (Shot Counter), and a second group of registers is created that tracks the interval between shots (cadence). If the above example is used, the registers allocate counted shots that meet a certain parameter. For example, register 0 may store the total count of shots fired. Register 1 stores shots fired at a firing rate of 750-900 rounds/min; register 2 stores the number of shots between 500-750 rounds/min. Other registers will store values for any other statistically important or required parameters to be recorded for the gun. Further, a simple histogram can be derived from each memory bin or location to give a "Shot Rate Profile."

For any shots fired over a pre-determined reasonable period of time (one second in this example) there is no need to store interval data. If all 5,000 rounds are fired at 10/second in this example register number 2 will be equal to the count in register 0. This indicates that the gun's wear and tear is high.

When it is determined that a particular firearm exceeds a pre-determined optimal MKSC then it may be brought in for preventative maintenance. Once maintenance is performed, the counts can be reset back to zero. A user can easily track the shot count status at any point in time by simply reading the information using a reader, such as a handheld reader, or picking up the information at a base station and transferring it to a computer. A web interface can be used to keep track of shot count for all of the weapons within a network, such as a police force, or military organization. In this manner, a user can monitor the MSKC for each firearm from a remote location and then advise the handler of the firearm when it is time to perform maintenance. This frees the soldier or officer on the field from having to keep track of the maintenance requirements.

In another embodiment, depending upon a weapon type, a weighted calculation is used, taking into account the interval data stored in registers 1-14 or similar intervals. The total number of shots fired stored in register 0, plus a weighted sum of the interval registers 1-14, can be used to establish maintenance and stats for the weapon 100. The weights may be empirical and determined based on actual wear and tear. For example, register 1 may have a weight of 10, 3 of 7 and so on based on the weapon and measured wear. The final calculated number is called the Mean Kinetic Shot Count and can be tied to maintenance schedules and weapons replacement. A typical weapon MKC profile might look like:

$$\text{MKC}=\text{Shot Counter}+(R2^*.8+R3^*.6+R4^*.3+R5^*.2+R6^*.1+R6^*.05+R7^*.05)$$

The activity parameter sensor 250 can detect the number of shots fired by using a piezoelectric sensor or by detecting the number of projectiles remaining in the cartridge. Another sensor 250 may be able to detect if the tag 102 has been removed from the handgun. In fact, additional sensors may be placed on the back of the tag 102 for just this purpose. Each instance of motion and/or acceleration is a status event and it is detected by the sensor 250. Sensors 250 are ideal for providing an event history of the event statuses they detect. Other sensors not mentioned here may be advantageously used within the spirit and scope of the invention.

Additionally, a clock 260 may be included inside the tag 102. The clock 260 can provide a time history to correspond with status events detected by the sensors 250. The clock 260 can be configured to provide a time signal to correspond with a signal emitted by the sensor 250. The processor 210 records the time signal together with the sensor signal in order to provide a temporal history that can be mapped to a status history. The history data can be stored in the memory 230 along with status events. Tying events to a time stamp provides for a more meaningful history of events. For example, mapping shots fired to a date and time affords very useful information.

The tag 102 may be programmed to emit a warning signal when at least one of the sensors 250 detects a condition that meets a predetermined value. For example, a sensor 250 in the tag 102 may emit a signal when the ammunition falls below a predetermined amount. A jog sensor 250 may emit a signal when the weapon 100 has been dropped. A signal could also be emitted when it is time to perform maintenance on the weapon 100.

To secure the stored data in the tag 102 an onboard crystal may be used to provide optical encoding using liquid crystal spatial light modulators. One-time pad ciphers are another security measure that can be advantageously used with a radio tag 102. Using known security measures with the radio tag 102 is recommended when needed to assure that the tag data does not fall into the wrong hands.

Figure 4:
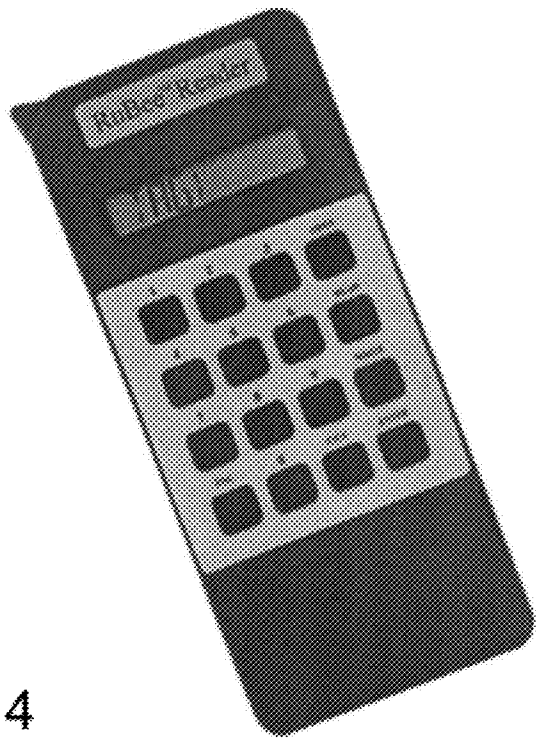
FIG. 4 shows a handheld reader that can be advantageously used according to an embodiment of the present invention.
Figure 4:
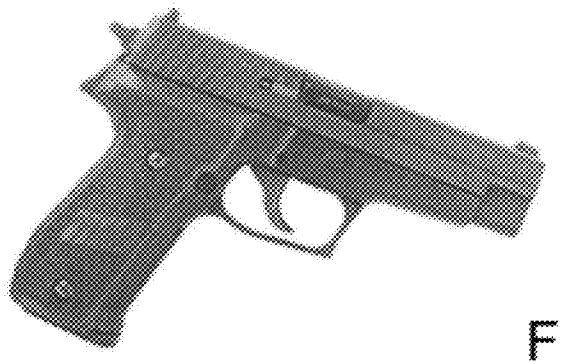

FIG. 4 shows a handheld reader that may be used to read and enter data to/from the radio tag 102. Although this method has the disadvantage of requiring an individual to be in proximity to the firearm 100, it has the advantage of being a low-cost way of quickly gathering data while out in the field and away from a computer. The handheld reader can be optimized with a USB port to facilitate downloading of data to a computer. The antenna 280 within the tag 102 is operable up to approximately fifteen feet. Without any additional antennas, the handheld reader would need to be within a fifteen-foot range of the tag 102 and positioned correctly to pick up the transmitted signals from the tag 102. Of course, the transmission field of the tag antenna 280 can be amplified exponentially by employing additional antennas.

The router 290 of FIG. 1 is a custom RuBee® router. RuBee® routers are designed to read data from multiple antennas at a low frequency. The router 290 has a built-in GPS unit, two USB ports, a serial port and high-speed Ethernet connection for communication with a central data processor. This enables the data stored in the tags 102 to be accessed remotely via a web-enabled computer. At any point in time, data about any of the firearms (or all of the firearms) within the network can be accessed real-time through a web browser.

The data storage within the tag 102 can store all of the information necessary to identify the weapon, its owner/carrier and its event history. Some of the data fields for weapon identification may include: a unique identifier for the weapon, its date of purchase, its location, its affiliation (such as police department), and its current maintenance status. Note that this is merely a representative sampling of the data which can be stored in a tag 102. As stated earlier, the data stored in the tags 102 is easily accessible via a handheld reader as shown in FIG. 4, or a computer. This presents a problem of securing this data so that it does not fall into the wrong hands. The data can be protected by assigning a personal identification number (PIN) so that only those users with the PIN can access the data. Alternatively, the data may be encrypted with Advanced Encryption Standard (AES) encryption. Only authorized personnel would have the key to decrypt the data.

FIG. 5 is an exemplary web-viewable report showing the data from the tags 102. IEEE P1902.1 offers a real-time, tag-searchable protocol using IPv4 addresses and subnet addresses linked to asset taxonomies that run at speeds of 300 to 9,600 Baud. RuBee® Visibility Networks are managed by a low-cost Ethernet enabled router 290. Individual tags and tag data may be viewed on a stand-alone system or a web server from anywhere in the world. Each RuBee® tag 102, if properly enabled, can be discovered and monitored over the World Wide Web using popular search engines (e.g., Google) or via the Visible Asset's .tag Tag Name Server.

Gathering information about one weapon is important. Equally important, if not more so, is gathering information about all of the weapons within a network. Note that in this discussion we refer to a "network" of weapons as all of the weapons within one networked RuBee® tag system. A network of weapons may or may not be restricted to one affiliation (such as a police department) or group of weapons (all revolvers). It is critical to track the shots fired, event histories, maintenance schedules, and condition of the weapons to be able to predict future events and to know what conditions will need to be changed and/or further monitored. It is well known in the art of database software that manipulating data in different ways produces different views of the data. Data from RuBee® tags 102 can be used for various purposes within the scope of this invention.

Figure 6:
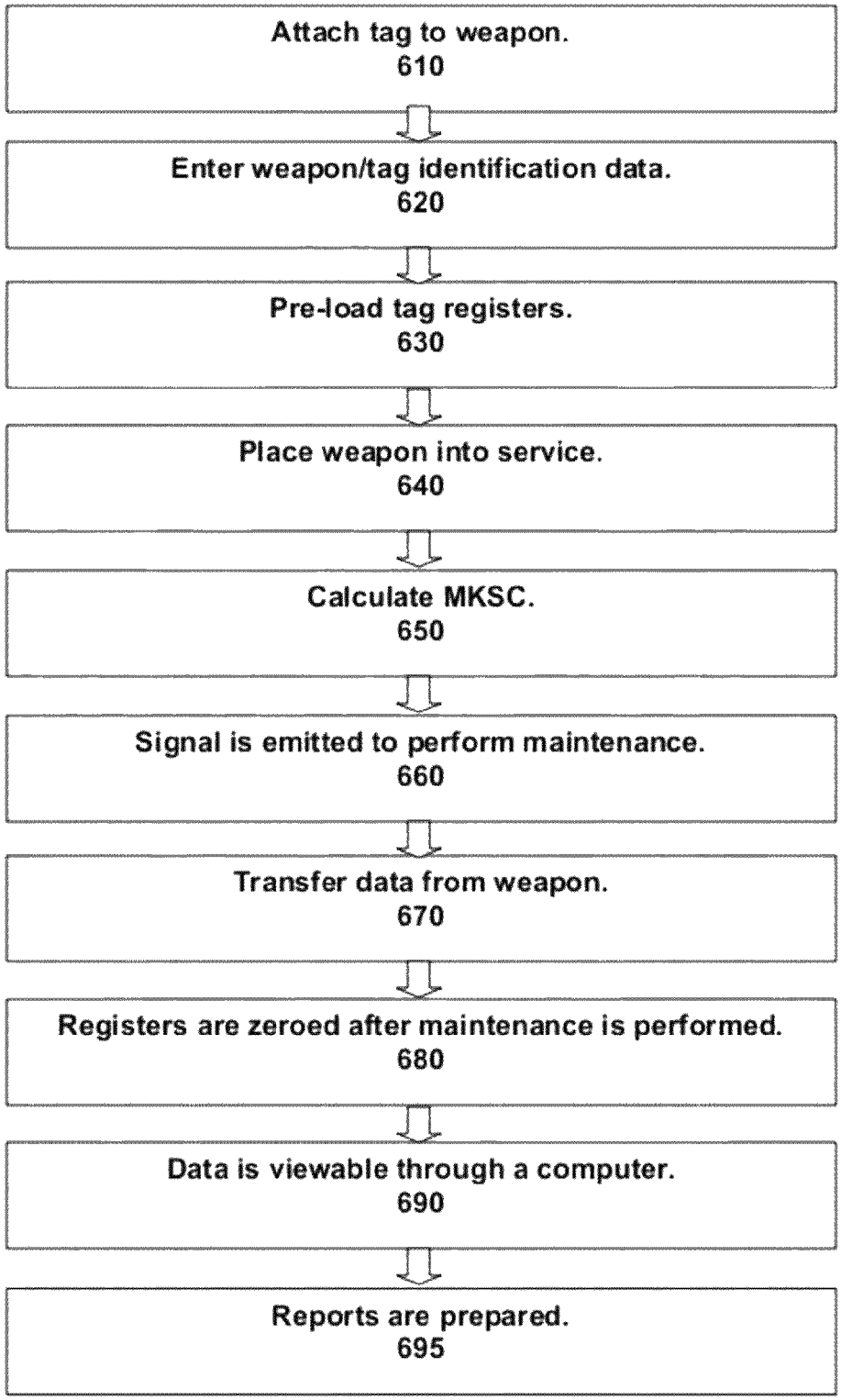
FIG. 6 is a flowchart of a method for tracking wear and tear of a firearm, according to an embodiment of the present invention.

FIG. 6 is a flow chart 600 of the process of implementing the MKSC according to the invention. The process begins at step 610 when a tag 102 is attached to a weapon. The tag 102 may be securely embedded in the firearm 100 as shown in FIG. 1, or it may be affixed to the firearm 100 in such a way that it is easily removable. A unique identifier is assigned to the tag 102, associating the tag 102 with the weapon 100. This unique identifier is also recorded to correspond to the weapon to which the tag 102 is attached. The identifier can be programmed into the tag 102 either before or after it is attached.

Next in step 620, other data concerning the weapon is entered. This data may be the model number, the purchase date, the affiliation (agency, police department), and/or the maintenance record of the weapon, to name just a few data items that can be stored in the tag 102. The tag 102 is enabled to constantly transmit low frequency radio signals through its modem 220. The radio tag 102 may also transmit a signal or signals responsive to the detection of a status event, such as a change in ammunition status of the weapon. Note that the data may be entered before attaching the tag 102 to the firearm 100.

In step 630 the tag registers are pre-loaded with the applicable weights. Pre-selected benchmarks are also programmed into the tag 102. These benchmarks may be: when the shot count reaches 1,000 the gun must be cleaned; when the shot count reaches 3,000, a signal must be transmitted to the base station requesting more ammunition; when more than 100 shots have been fired at a cadence over eight shots per second, a warning signal should be emitted, and so forth.

In step 640 the firearm 100 is put into (or returned to) service. In step 650 the shot counter records each shot fired, and the cadence of the shots is recorded in the appropriate registers. In step 650 at predetermined intervals, the MKSC is calculated from the data stored in the registers. Alternatively, the MKSC can be calculated and stored on a continuous basis, in real-time.

In step 660 an onboard sensor emits a signal when a benchmark is reached. The signal will indicate that maintenance should be performed on the firearm. Alternatively, a user monitoring the MKSC may transmit a signal to the tag 102 in order to sound an alarm so that the firearm handler knows to perform maintenance.

In step 670 the data from the tag 102 is transmitted to a remote location for storage before the registers are zeroed. In this way, complete service data is kept for each firearm 100. The radio tag 102 signals are picked up by a reader operable to receive low frequency radio signals below 450 kilohertz within range of the tag antenna 280. The reader may be a handheld reader, such as a wand reader. The signals may also be picked up by a router 290, or another tag in the network. The data is then transmitted via a wireless connection (or a wired connection if a local network is used) to a computer. The data may be encrypted with known encryption methods. As stated earlier, a web interface is an ideal way to provide secure access to meaningful data. A user will be required to log into the network. The firearm data can be accessed individually by selecting the unique identifiers for each firearm, or the firearm network data can be viewed in its entirety.

In step 680 after a full maintenance is performed, the registers are zeroed out. This zeroing out can be activated remotely when the processor 210 receives a signal that maintenance has been performed. The processor 210 can then perform a load instruction to load zeroes into the registers. In an alternative embodiment, a handler performing full maintenance on the firearm 100 disassembles the firearm 100, exposing the radio tag 102. A button on the tag 102 can be pressed once the maintenance is complete. This is analogous to a driver pressing a button to zero out a trip counter at the end of a car trip.

In step 690 the transmitted data, after it is decrypted, if necessary, is viewable through a computer. The data may be accessed from a database configured to process the tag data and displayed through a computer monitor, or a personal digital assistant (PDA) screen, a cell phone display, or any other display means according to advancing technology. The data may also be viewable via web browser. When the data is available on the Internet, it then becomes critical to safeguard the data, either by requiring a login and password, or using data encryption methods known in the art. In one embodiment, the login name may be the serial number of the weapon.

In step 695, the data gathered from the tag 102 or all of the tags in the network may be compiled into a report such as that shown. The report may be confined to one particular weapon, showing event and time histories for that weapon, or it may report on some or all of the weapons within an inventory shelf or a network. The report may be produced daily, monthly, seasonally, or yearly. The report may be automatically generated or may be generated upon user request. Optionally, a report may be auto-generated according to data received from the tag 102 which meets a pre-determined condition. For example, a user might want a report on a particular weapon generated when an ammunition sensor registers that the weapon has been fired. The report may be viewable on the Internet and/or distributed to appropriate personnel.

Therefore, information gathered from a report may be used to add to or change the programming of the tags. To implement this, a user would make any needed changes on a computer. The data is transmitted to a RuBee® router 290 which in turn communicates with a radio tag 102 through its antenna (either the tag antenna directly or a field antenna). The modem 220 of the tag 102, using the chipset 225 transmits the signals to the processor 210. The processor 210 records the data and makes the necessary changes. Many other additions and modifications can be made to the data to assist an end user in monitoring and tracking weapons within a network.

Therefore, while there have been described what are presently considered to be the preferred embodiments, it will be understood by those skilled in the art that other modifications can be made within the spirit of the invention. The above descriptions of embodiments are not intended to be exhaustive or limiting in scope. The embodiments, as described, were chosen in order to explain the principles of the invention, show its practical application, and enable those with ordinary skill in the art to understand how to make and use the invention.

We claim:

1. A system for tracking shots fired from a firearm, the system comprising:

a low frequency networked radio tag coupled with the firearm, said radio tag configured to receive and send data signals, the radio tag comprising:

a modem;

a tag antenna operable at a low radio frequency not exceeding 300 kilohertz;

a transceiver operatively connected to the tag antenna, said transceiver configured to transmit and receive data signals at the low radio frequency;

a data storage device configured to store data comprising identification data for identifying the firearm and shot count data;

a processor configured to process data received from the transceiver and the data storage device and to transmit data to cause said transceiver to emit an identification signal based upon the identification data stored in said data storage device;

a shot count register operatively coupled with the processor for tracking a number of shots fired, wherein the shot count register is incremented each time a shot is fired;

a plurality of cadence registers operatively coupled with the processor for tracking an interval between shots;

a shot sensor for detecting when a shot has been fired from the firearm; a timing mechanism for recording time used to determine shot cadence; and a connector for a power source to power the processor and the transceiver.

2. The system of claim 1 wherein the radio tag is embedded in a handle of the firearm.

3. The system of claim 1 wherein the radio tag is housed in a waterproof casing.

4. The system of claim 1 wherein the identification data comprises an internet protocol address, and the processor is operable for communication with an internet router using said internet protocol address, such that at least a portion of the identification data can be transmitted through the internet router to be viewable through a web browser.

5. The system of claim 1 further comprising a data store for storing firearm performance parameters.

6. The system of claim 1, wherein the radio tag further comprises an onboard crystal used for data encryption.

7. The system of claim 1, further comprising the energy source operable for activating the transceiver and the processor.

8. The system of claim 1, further comprising: a reader in operative communication with the tag antenna, said reader configured to receive data signals from the radio tag.

9. The system of claim 8, further comprising: at least one field antenna disposed at an orientation and within a distance from the radio tag that permits effective communication therewith at the low radio frequency.

10. The system of claim 9, wherein the at least one field antenna comprises a large loop, wherein a distance from the at least one field antenna to the tag does not exceed a major dimension of said large loop.

11. The system of claim 9 wherein the at least one field antenna is positioned vertically.

12. The system of claim 1, further comprising: a transmitter in operative communication with the tag antenna, said transmitter being operable to send data signals to the radio tag.

13. The system of claim 11 wherein the reader, and at least one field antenna, and a transmitter are combined into a handheld device configured for reading and transmitting signals to and from the radio tag.

14. The system of claim 11 further comprising: a central data processor in operative communication with the reader.

15. A method for identifying, tracking and monitoring a firearm, said method comprising steps of:

attaching a low frequency radio tag to the firearm, said radio tag comprising a tag antenna operable at a low radio frequency not exceeding 450 kilohertz, a transceiver operatively connected to said antenna, said transceiver being operable to transmit and receive data signals at said low radio frequency, a data storage device configured to store data comprising identification data for identifying said radio tag, a processor operable to process data received from said transceiver and said data storage device and to send data to cause said transceiver to emit an identification signal based upon said identification data stored in said data storage device; a shot count register operatively coupled with the processor for tracking a number of shots fired, wherein the shot count register is incremented each time a shot is fired; a plurality of cadence registers operatively coupled with the processor for tracking an interval between shots; a shot sensor for detecting when a shot has been fired from the firearm; a timing mechanism for recording time used to determine the shot cadence; and a connector for an energy source for activating said transceiver and said processor; storing, in the data storage device of the radio tag, data comprising identification data relating to said firearm;

reading the identification data from the transceiver of the radio tag by interrogating said radio tag with radio frequency interrogation signals at a low radio frequency not exceeding 450 kilohertz via said tag antenna; and transmitting the identification data and the shot count data.

16. The method of claim 15, wherein the transmitting step comprises transmitting the identification data from the radio tag to a central data processor.

17. The method of claim 15 further comprising a step of: generating a report detailing the transmitted data.

18. The method of claim 15 wherein the unique identifier is used as a key to access data about the firearm.

19. The system of claim 1, wherein the radio tag further comprises at least one sensor operable to generate a status signal upon sensing a pre-determined status condition.

* * * * *